US006779600B2

(12) United States Patent
King et al.

(10) Patent No.: US 6,779,600 B2
(45) Date of Patent: Aug. 24, 2004

(54) LABYRINTH LOCK SEAL FOR HYDROSTATICALLY SET PACKER

(75) Inventors: James King, Houston, TX (US); Edward Wayne Welch, Jr., Fresno, TX (US)

(73) Assignee: BAker Hughes Incorporated, Houston, TX (US)

( * ) Notice: Subject to any disclaimer, the term of this patent is extended or adjusted under 35 U.S.C. 154(b) by 0 days.

(21) Appl. No.: 09/916,985

(22) Filed: Jul. 27, 2001

(65) Prior Publication Data

US 2003/0019623 A1 Jan. 30, 2003

(51) Int. Cl.[7] ..... E21B 23/06; F16J 15/447

(52) U.S. Cl. ..... 166/120; 166/118; 166/134; 166/182; 277/412; 277/418; 277/420

(58) Field of Search ..... 166/387, 118, 166/120, 134, 182; 277/409, 412, 418, 419, 420, 324, 328, 505

(56) References Cited

U.S. PATENT DOCUMENTS

| | | | | |
|---|---|---|---|---|
| 4,264,285 A | | 4/1981 | Erickson et al. | |
| 4,743,034 A | * | 5/1988 | KaKabaker et al. | 277/53 |
| 4,858,644 A | | 8/1989 | Decker | |
| 4,886,126 A | | 12/1989 | Yates, Jr. | |
| 5,024,451 A | * | 6/1991 | Borowski | 277/53 |
| 5,103,901 A | * | 4/1992 | Greenlee | 166/120 |
| 5,190,440 A | * | 3/1993 | Maier et al. | 415/174.5 |
| 5,320,183 A | | 6/1994 | Muller et al. | |
| 5,403,019 A | * | 4/1995 | Marshall | 277/53 |
| 5,680,905 A | | 10/1997 | Green et al. | |
| 5,720,349 A | * | 2/1998 | Pleasants et al. | 166/298 |
| 5,803,179 A | | 9/1998 | Echols et al. | |
| 6,016,880 A | * | 1/2000 | Hall et al. | 175/195 |
| 6,325,382 B1 | * | 12/2001 | Iwamoto et al. | 277/368 |
| 6,467,547 B2 | * | 10/2002 | Maguire et al. | 166/386 |

FOREIGN PATENT DOCUMENTS

| | | | |
|---|---|---|---|
| DE | 2158720 | 5/1973 | |
| GB | 2320269 | 6/1998 | |
| WO | WO 9854439 A1 * | 12/1998 | E21B/34/10 |

* cited by examiner

*Primary Examiner*—David Bagnell
*Assistant Examiner*—Giovanna M. Collins
(74) *Attorney, Agent, or Firm*—Steve Rosenblatt

(57) ABSTRACT

A hydrostatically set packer is disclosed. The actuating piston is locked for run in by a lock sleeve and lock dog arrangement. When the desired depth is reached well pressure is built up to break a rupture disc to allow hydrostatic pressure to act on one side of a lock sleeve. The other side of the lock sleeve is exposed to a chamber under atmospheric or low pressure. Movement of the lock sleeve releases the lock dog allowing piston movement to set the packer. The lock sleeve has a labyrinth seal so that seal leakage below a predetermined level will not prematurely activate the piston lock and prematurely set the packer. A variety of designs for the labyrinth are described.

17 Claims, 7 Drawing Sheets

LABYRINTH LOCK SEAL FOR HYDROSTATICALLY SET PACKER

FIELD OF THE INVENTION

The field of this invention is labyrinth seal design as well as a particular application to a lock for a hydrostatically set packer.

BACKGROUND OF THE INVENTION

Hydrostatically set devices for subterranean wells such as packers in the past have relied on an initially locked piston. When the packer was placed at the desired depth, the locking mechanism was released, generally by pressurization of the wellbore, or an electromechanical device or system. The electromechanical devices include, but are not limited to, systems that rely on acoustic, pressure pulse, or vibratory communication methods to enable the setting sequence of the packer or other downhole device. The applied wellbore pressure would break a rupture disc to expose the lock to hydrostatic pressure. In the embodiment of the electromechanical device, the device would expose the lock to hydrostatic pressure. Hydrostatic pressure, acting on one side of the lock against an atmospheric chamber on the other side of the lock, allowed the lock to move. Release of the lock permits piston movement. The piston moves due to the force of hydrostatic pressure across the piston which would set the slips and compress the seal against the borehole wall or tubular, or otherwise actuate the device. A lock ring would hold the set.

A potential problem with this known design was that seal leakage could allow pressure to prematurely communicate to one side of the lock so that the packer would be prematurely unlocked and consequently, hydrostatically set. Thus, an objective of the present invention is to acknowledge that seal leakage is a potential occurrence with drastic and expensive consequences and to deal with that possibility. The objective is met using a wide variety of labyrinth seals on the lock sleeve assembly. Even if leakage of the seals below a predetermined level were to occur, the labyrinth seal would prevent a net force from occurring on the lock sleeve, thus preventing premature hydrostatic setting of the packer.

Labyrinth seals have been used in different tools in downhole applications. They have been used in perforating guns, as shown in U.S. Pat. Nos. 4,886,126 and 5,680,905. They have been used in downhole turbo-machines, U.S. Pat. No. 4,264,285 and in a fluid flow regulator, U.S. Pat. No. 4,858,644. Hydraulically released locks for packers have been used in U.S. Pat. No. 5,320,183.

U.S. Pat. No. 5,720,349 shows the use of a labyrinth seal in an assembly of an anchor, whipstock, and a starter mill. The labyrinth seal compensates for thermal expansion of a fluid filled system to prevent setting of the anchor due to pressure that would have otherwise built up due to thermal effects. This device is focused on compensation for pressure from thermal expansion. On the other hand, U.S. Pat. No. 5,689,905, in the context of a perforating gun, is focused on use of the labyrinth seal to prevent premature actuation of the gun due to seal leakage. Those skilled in the art will appreciate the scope of this invention from the description of the preferred embodiment, which appears below and the claims, which appear thereafter.

SUMMARY OF THE INVENTION

A hydrostatically set packer is disclosed. The actuating piston is locked for run in by a lock sleeve and lock dog arrangement. When the desired depth is reached well pressure is built up to break a rupture disc to allow hydrostatic pressure to act on one side of a lock sleeve. The other side of the lock sleeve is exposed to a chamber under atmospheric or low pressure. Movement of the lock sleeve releases the lock dog allowing piston movement to set the packer. The lock sleeve has a labyrinth seal so that seal leakage below a predetermined level will not prematurely activate the piston lock and prematurely set the packer. A variety of designs for the labyrinth are described.

DETAILED DESCRIPTION OF THE PREFERRED EMBODIMENT

Figure 1A:
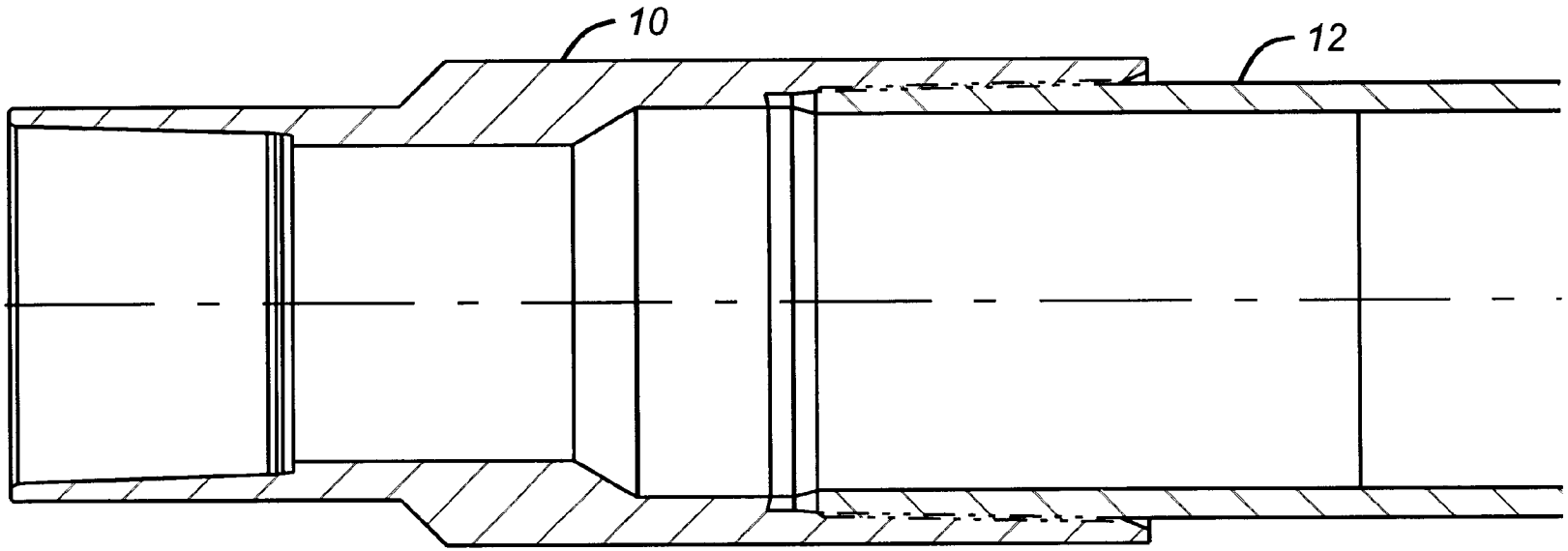
FIGS. 1*a*–1*e* are a section view of a hydrostatically set packer with the labyrinth seal on the lock sleeve for the actuating piston.
Figure 1B:
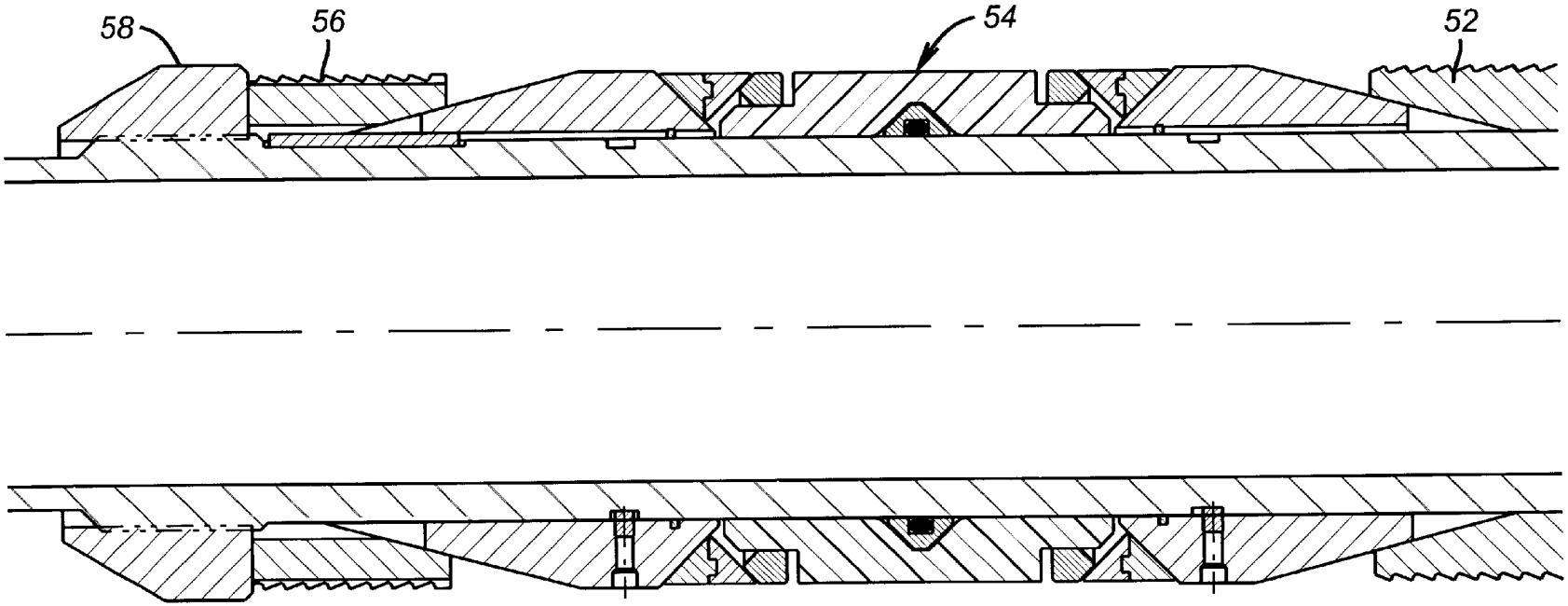
Figure 1C:
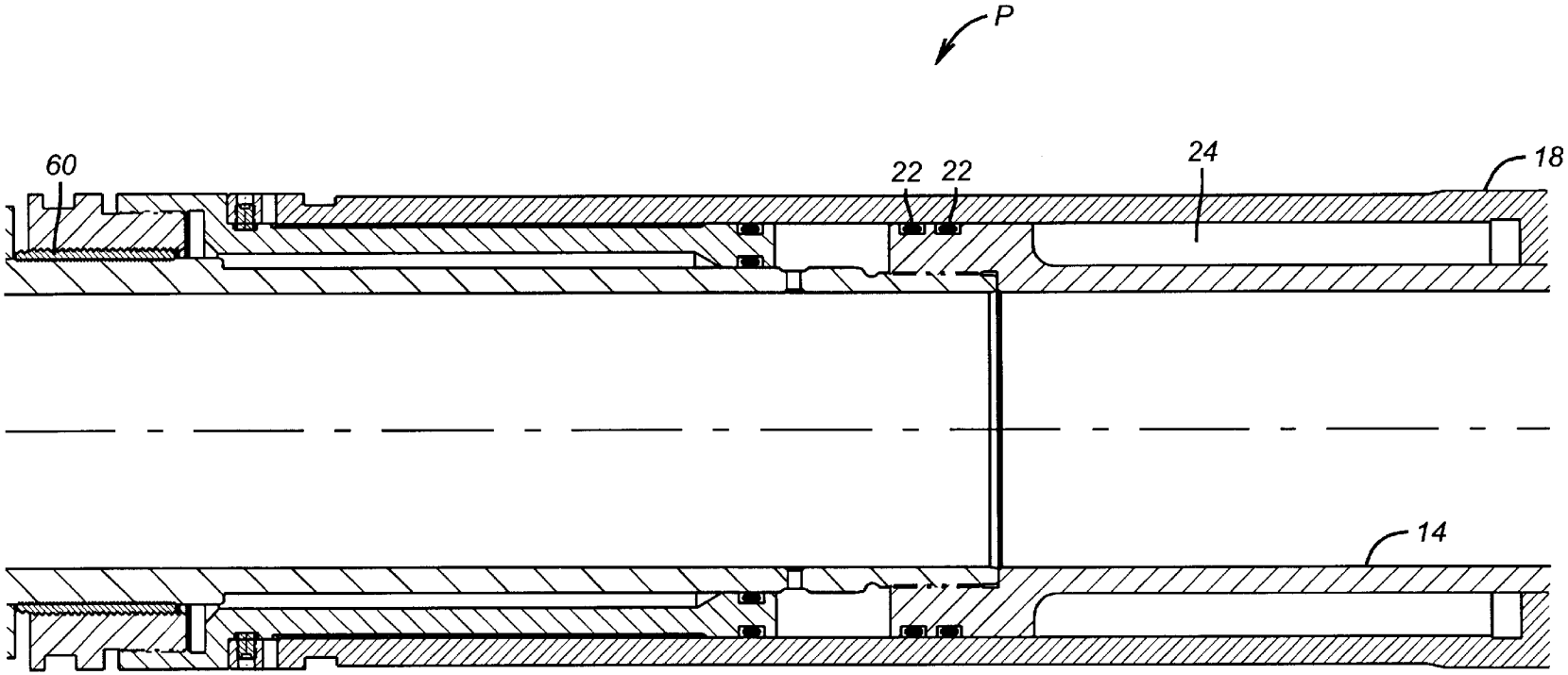

Referring to FIGS. 1*a*–1*e*, the packer P of the invention has a top sub 10 used to secure a tubing string (not shown). The upper mandrel 12 is connected to top sub 10. The lower mandrel 14 is connected to the upper mandrel 12 and the bottom sub 16 is below the lower mandrel 14. A piston 18 is mounted around the upper mandrel 12 and lower mandrel 14 and with seal pairs 20 and 22 defines an atmospheric cavity 24. An outer sleeve 26 is connected to bottom sub 16 at one end and extends to piston 18 at the other end. Seal pairs 28 and 30 define an annular cavity in which the lock sleeve 32 is disposed. Lock sleeve 32 has a seal pair 34 so as to create opposed sealed cavities 36 and 38 on opposed sides of lock sleeve 32. Bottom sub 16 has a passage 40, which is initially blocked by a rupture disc 42. Passage 40 extends into cavity 38.

Lock sleeve 32 has a cylindrical extension 44 with a shear pin 46 extending into piston 18. Dog 48 is held into groove 50 by cylindrical extension 44. Piston 18 is trapped against movement until lock sleeve 32 has moved breaking the shear pin 46 and undermining the force holding the dog 48 in the groove 50. Since cavity 24 is at atmospheric or low pressure, the net force to piston 18 moves it up against lower slip 52, which in turn compresses seal assembly 54 and upper slip 56 against stop 58. A lock ring 60 holds the set position.

In operation, the packer P is lowered to the desired position and pressure is built up to break the rupture disc. The burst pressure of the rupture disc 42 is set higher than the anticipated hydrostatic pressure anticipated at the setting depth. Other devices for allowing selective access into passage 40 can be alternatively used. Once the rupture disc is broken, pressure builds in cavity 38. Since cavity 36 is at or close to atmospheric pressure, the pressure buildup in cavity 38 moves the lock sleeve and the collet integral to it, up hole to break the shear pin 46 and to release dog 48 from groove 50. Now with the lock sleeve 32 abutting the piston 18, pressure in cavity 38 also acts on piston 18. Since cavity 24 is at atmospheric there is little resistance to the uphole movement of piston 18 and the packer P sets in the manner described above. This is the normal operation.

Figure 1D:
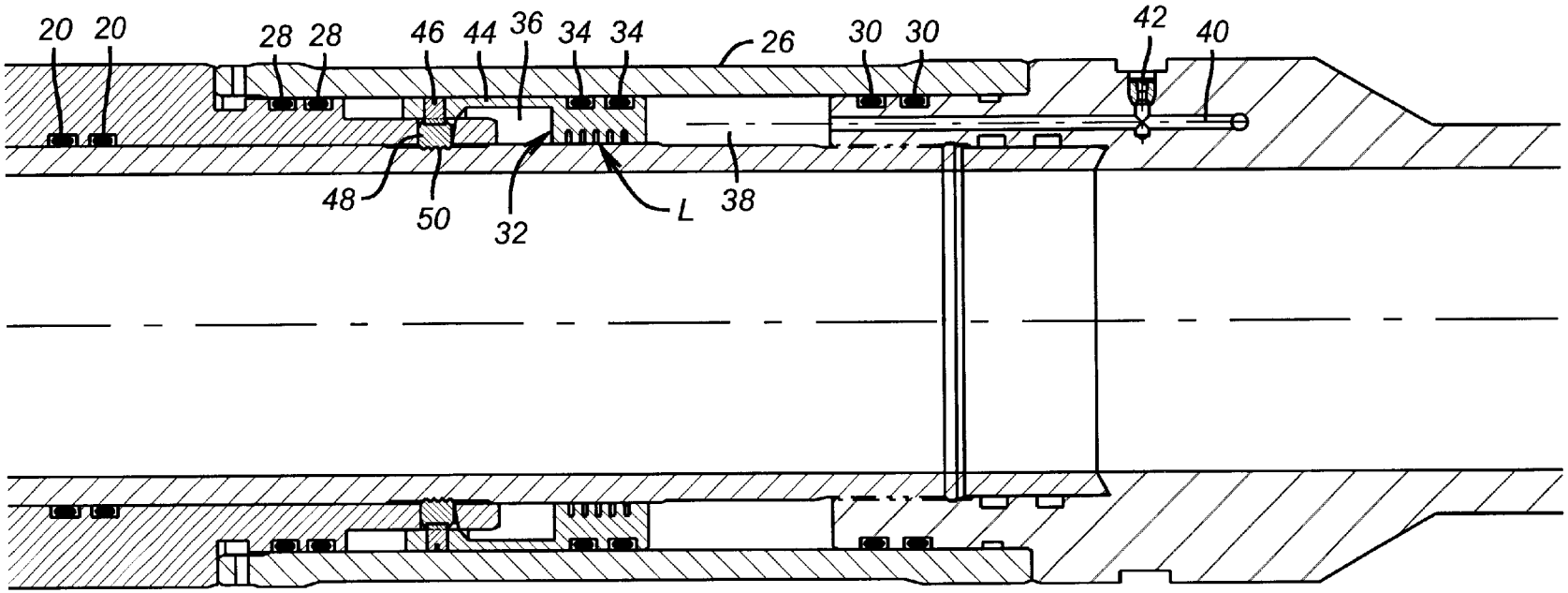
Figure 1E:
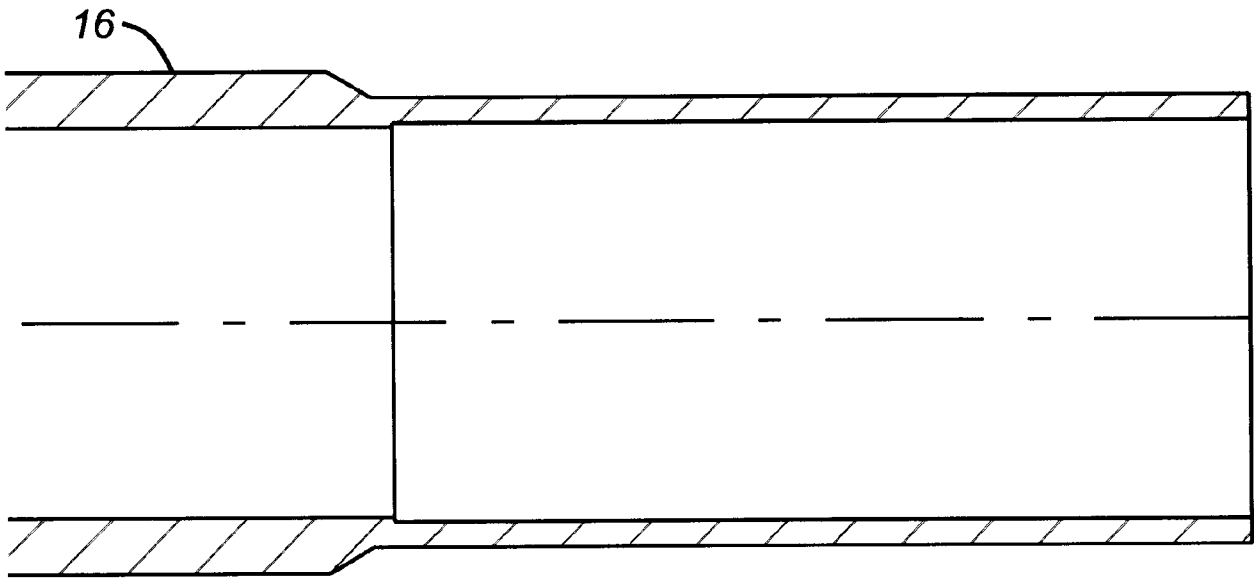
Figure 2:
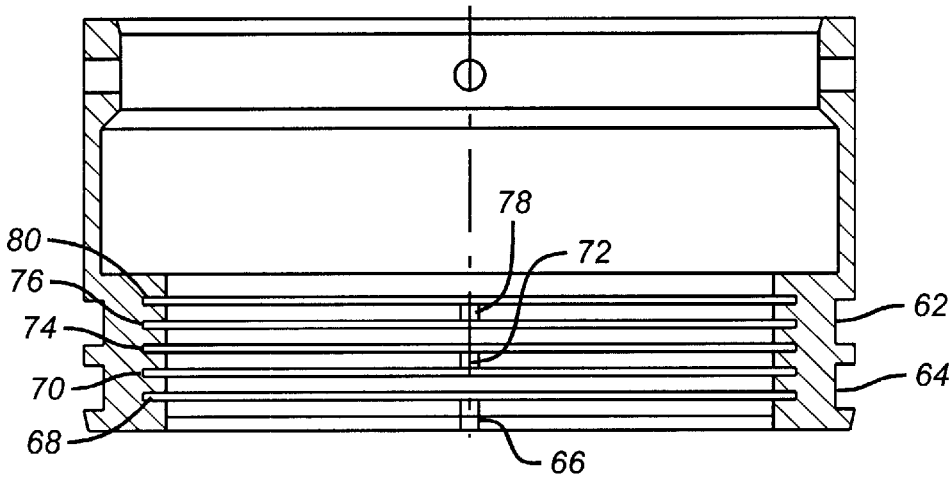
FIG. 2 is a section view of the labyrinth seal shown in FIG. 1.

The present invention modifies the above-described design by an addition of a labyrinth seal L to the lock sleeve 32. Various embodiments are illustrated in FIGS. 2–5. The embodiment of FIG. 1*d* is shown in greater detail in FIG. 2. Grooves 62 and 64 retain seal pair 34 (not shown in FIG. 2).

Figure 5:
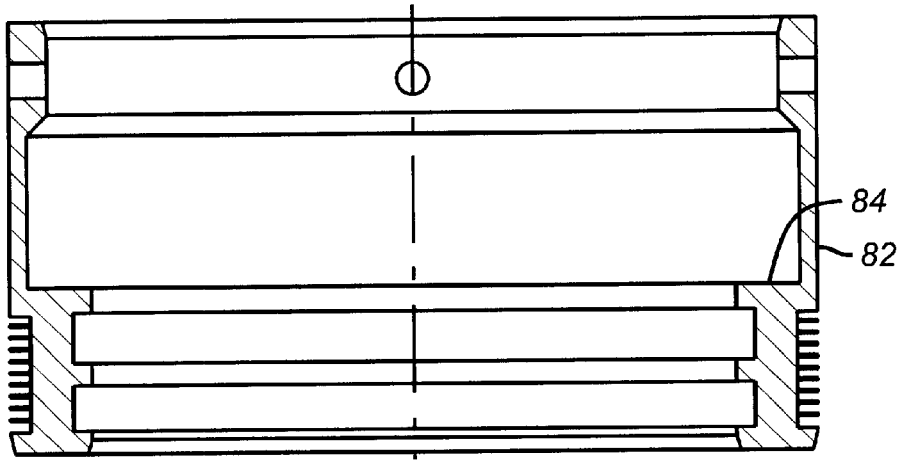
FIG. 5 is the preferred embodiment of the labyrinth seal, showing it externally mounted.

The tortuous path starts with longitudinal groove 66, which leads to circular groove 68. Flow must go 180 degrees to reach another longitudinal groove (not shown) to get into circular groove 70. From there the flow must go around 180 degrees to another longitudinal groove 72 and into circular groove 74. From there the flow is circumferential to another longitudinal groove (not shown) to groove 76. Thereafter, flow goes circumferentially to longitudinal groove 78 and out into circular groove 80. FIG. 5 is in essence the same design except the tortuous path is on the outside surface 82 rather than the inside surface 84. Placing the tortuous path on the outside is preferred because it simplifies the machining of the part.

Figure 3:
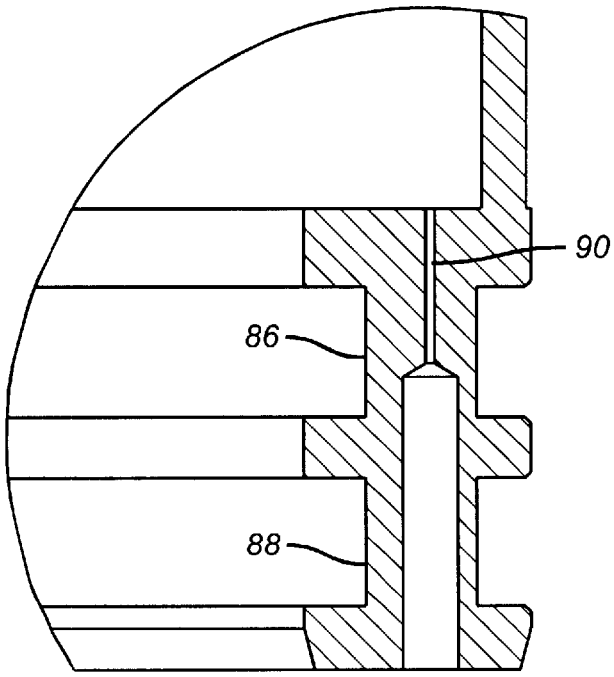
FIG. 3 is an alternative embodiment of the labyrinth seal using a pinhole leak path.
Figure 4:
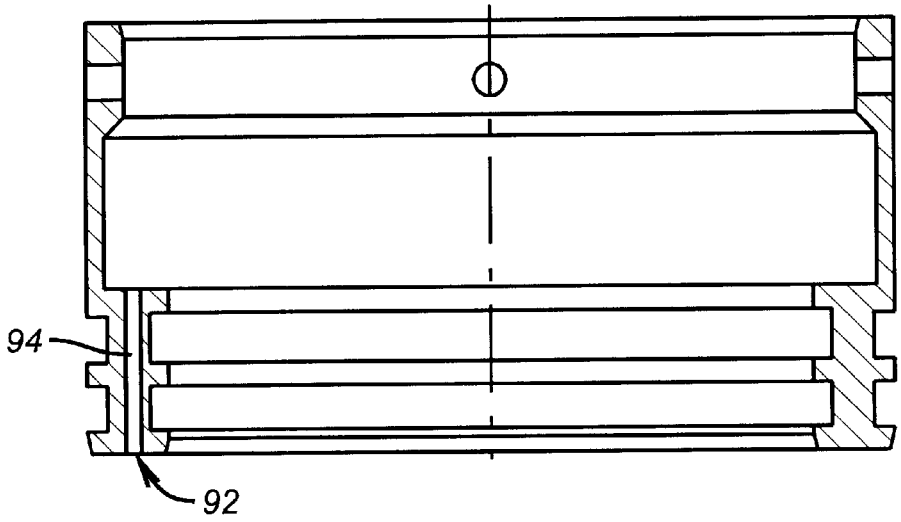
FIG. 4 is an alternative embodiment of the labyrinth seal showing the use of a flow restrictor.

In FIG. 3, grooves 62 and 64 are opposed by grooves 86 and 88 to accommodate opposed seal pairs such as 34 (shown in FIG. 1*d*). The leak path 90 is machined or cast into lock ring 32, depending how the part is produced. Alternatively, a commercially available restrictor, represented schematically by arrow 92 can be mounted in bore 94.

The advantage of using any of these versions or any others that allow a leak rate of a predetermined value to occur without moving the lock sleeve 32 is that premature setting will not occur due to leakage up to a predetermined rate past seals 28 or 30. But for the labyrinth seal of the present invention leakage past seal pairs 28 or 30 will force movement of lock sleeve 32 liberating piston 18 to move to set the packer P. Leakage of seals 20 or 22 will simply prevent piston 18 from moving because no pressure differential exists once cavity 24 equalizes with the downhole environment. The packer P will not set if there is leakage around seals 34, which is sufficiently severe. If that happens, hydrostatic pressure will not be able to put sufficient differential pressure on lock sleeve 32 to move it to break shear pin 46 and liberate dog 48.

Those skilled in the art will appreciate that if the hydrostatic pressure at the setting depth is too low, the packer P can be set with applied well pressure into passage 40 after breaking the rupture disc 42. Dissolving plugs or other temporary barriers or valves actuated from the tool or the surface can be used in place of rupture disc 42. The invention may be used on any downhole tool which has a hydrostatically set feature including a sleeve valve, ball valve, shifting mechanism, hole punching mechanism, pressure equalizing mechanism, tool or tool component deployment mechanism, or other hydrostatically powered mechanism.

It is to be understood that this disclosure is merely illustrative of the presently preferred embodiments of the invention and that no limitations are intended other than as described in the appended claims.

We claim:

1. A downhole hydrostatically settable tool comprising:

a mandrel;

a piston mounted to said mandrel;

a moveable component actuated by said piston;

a slideably mounted lock assembly, for said piston, mounted to an enclosure defined at least in part by said mandrel and selectively movable in response to exposure of one part of said lock assembly in said enclosure to downhole hydrostatic pressure;

said lock assembly further comprising a labyrinth seal mounted to said lock assembly in said enclosure and allowing a leak flow therethrough without allowing said piston to be unlocked.

2. The tool of claim 1, wherein:

said moveable component further comprises a gripping assembly on said mandrel selectively actuated by said piston;

said lock assembly comprises an interior surface closest to said mandrel and an outer surface; and said labyrinth seal is disposed on said outer surface.

3. The tool of claim 2, wherein:

said labyrinth seal comprises a plurality of circumferential grooves with adjacent grooves connected by at least one longitudinal groove, said longitudinal grooves are offset from each other as between adjacent circumferential grooves.

4. The tool of claim 1, wherein:

said lock assembly comprises an interior surface closest to said mandrel and an outer surface; and said labyrinth seal is disposed on said interior surface.

5. The tool of claim 4, wherein:

said labyrinth seal comprises a plurality of circumferential grooves with adjacent grooves connected by at least one longitudinal groove, said longitudinal grooves are offset from each other as between adjacent circumferential grooves.

6. The tool of claim 1, wherein:

said labyrinth seal comprises a plurality of circumferential grooves with adjacent grooves connected by at least one longitudinal groove, said longitudinal grooves are offset from each other as between adjacent circumferential grooves.

7. The tool of claim 1, wherein:

said labyrinth seal comprises a longitudinal bore extending through said lock assembly.

8. The tool of claim 1, wherein:

said labyrinth seal comprises a longitudinal bore extending through said lock assembly; and a restrictor mounted in said bore.

9. The tool of claim 8, wherein:

said restrictor is removably mounted.

10. The tool of claim 1, further comprising:

a sealing assembly selectively actuated by said piston.

11. The tool of claim 10, further comprising:

a lock to hold slips and said sealing assembly outwardly from said mandrel after said piston has moved.

12. A labyrinth seal for a downhole tool component, comprising:

a body having an upper and a lower end;

at least three circumferential grooves on said body with adjacent grooves and said upper and lower ends connected by a plurality of longitudinal grooves on said body, said longitudinal grooves are offset from each other as between adjacent circumferential grooves, said circumferential and longitudinal grooves providing a leakage flow path between said upper and said lower end with openings at both ends.

13. The labyrinth seal of claim 12, wherein:

the downhole component comprising an annular shape with an inside and an outside surface and said circumferential and longitudinal grooves are disposed on said inside surface.

14. A labyrinth seal for a downhole tool component, comprising:

a body having an upper and a lower end;

at least three circumferential grooves on said body with adjacent grooves and said upper and lower ends connected by a plurality of longitudinal grooves on said body, said longitudinal grooves are offset from each other as between adjacent circumferential grooves, said circumferential and longitudinal grooves providing a leakage flow path between said upper and said lower end;

the downhole component comprising an annular shape with an inside and an outside surface and said circumferential and longitudinal grooves are disposed on said outside surface.

15. A seal for a downhole tool component, comprising:

a body movably mounted to the downhole component in response to a selectively applied differential pressure across said body;

said body comprising at least one longitudinal bore extending through said body and having open ends to allow a predetermined leakage flow therethrough to prevent differential pressure buildup across said body in the absence of said applied differential pressure, said bore devoid of labyrinth grooves.

16. The seal of claim 15, further comprising:

a flow restrictor mounted in said bore.

17. The seal of claim 16, wherein:

said flow restrictor is removably mounted.

* * * * *